US008786538B2

(12) United States Patent
Byun et al.

(10) Patent No.: US 8,786,538 B2
(45) Date of Patent: Jul. 22, 2014

(54) DISPLAY DEVICE AND METHOD FOR CONTROLLING GATE PULSE

(75) Inventors: Sunguk Byun, Daegu (KR); Keuksang Kwon, Gumi-si (KR); Nakjin Seong, Gyeongbuk (KR); Sangsoo Han, Gyeongbuk (KR); Kyuman Lee, Gumi-si (KR); Dongkyoon Heo, Busan (KR)

(73) Assignee: LG Display Co., Ltd., Seoul (KR)

( * ) Notice: Subject to any disclaimer, the term of this patent is extended or adjusted under 35 U.S.C. 154(b) by 454 days.

(21) Appl. No.: 12/977,453

(22) Filed: Dec. 23, 2010

(65) Prior Publication Data

US 2011/0157132 A1 Jun. 30, 2011

(30) Foreign Application Priority Data

Dec. 30, 2009 (KR) ..... 10-2009-0133709

(51) Int. Cl.
*G09G 3/36* (2006.01)

(52) U.S. Cl.
CPC ..... *G09G 3/3677* (2013.01); *G09G 2310/066* (2013.01); *G09G 2320/0219* (2013.01); *G09G 2330/021* (2013.01); *G09G 2310/0291* (2013.01); *G09G 2300/0426* (2013.01)
USPC ..... 345/100; 345/99

(58) Field of Classification Search
USPC ..... 345/211, 87, 99, 100, 98
See application file for complete search history.

(56) References Cited

U.S. PATENT DOCUMENTS

| | | | | |
|---|---|---|---|---|
| 7,808,494 | B2 * | 10/2010 | Lee et al. | 345/206 |
| 2005/0219187 | A1 * | 10/2005 | Shih | 345/94 |
| 2006/0158412 | A1 | 7/2006 | Morita | |
| 2006/0170658 | A1 * | 8/2006 | Nakamura et al. | 345/173 |
| 2008/0303765 | A1 * | 12/2008 | Nakatsuka | 345/87 |

FOREIGN PATENT DOCUMENTS

KR 10-2005-0046173 5/2005

* cited by examiner

*Primary Examiner* — Chanh Nguyen
*Assistant Examiner* — Tsegaye Seyoum
(74) *Attorney, Agent, or Firm* — McKenna Long & Aldridge LLP

(57) ABSTRACT

A display device comprises a display panel including data lines and gate lines crossing each other, a data driving circuit configured to convert digital video data into data voltages which are supplied to the data lines, a gate driving circuit configured to sequentially supply gate pulses to the gate lines, wherein a voltage of each of the gate pulses increases from a gate low voltage to a precharging voltage during a first rising time and thereafter increases from the precharging voltage to a gate high voltage during a second rising time, and wherein the voltage of each of the gate pulses decreases from the gate high voltage to the precharging voltage during a first falling time and thereafter decreases from the precharging voltage to the gate low voltage during a second falling time.

17 Claims, 19 Drawing Sheets

DISPLAY DEVICE AND METHOD FOR CONTROLLING GATE PULSE

This application claims the benefit of Korea Patent Application No. 10-2009-0133709 filed on Dec. 30, 2009, the entire contents of which are incorporated herein by reference for all purposes as if fully set forth herein.

BACKGROUND

1. Field of the Invention

This document relates to a display device and a method for controlling gate pulses.

2. Related Art

A liquid crystal display ("LCD") has been widely applied due to its lightweight, thin profile, lower power consumption driving, and so on. Such an LCD has been employed as a portable computer such as a notebook PC, an office automation device, an audio/video device, an indoor/outdoor advertisement display device or the like. The LCD displays images by controlling an electric field applied to an LC layer to adjust a light from a backlight unit depending on data voltages.

An active matrix LCD includes an liquid crystal display panel assembly provided with TFTs (thin film transistors) which are formed at the respective pixels and switch data voltages supplied to pixel electrodes, data driving circuits which supply data voltages to data lines in the liquid crystal display panel assembly, gate driving circuits which sequentially supply gate pulses (or scan pulses) to gate lines in the liquid crystal display panel assembly, and a timing controller which controls operation timings of the above-described driving circuits.

In FIG. 1, a "source drive IC (integrated circuit) output" is an example of a data voltage with a positive polarity and a data voltage with a negative polarity output from the data driving circuits. "SCAN1 to SCAN4" are examples of gate pulses sequentially output from the gate driving circuits. As shown in FIG. 1, the gate pulses swing between the gate low voltage VGL and the gate high voltage VGH. The gate low voltage VGL is less than a threshold voltage of the TFT as about −5V, and the gate high voltage VGH is a voltage equal to or more than a threshold voltage of the TFT.

At the rising edge of each of the gate pulses SCAN1 to SCAN4, the voltage rapidly increases from the gate low voltage VGL to the gate high voltage VGH. At the falling edge of each of the gate pulses, the voltage rapidly decreases from the gate high voltage VGH to the gate low voltage VGL. Thereby, since the currents Ileak rapidly increase in the gate lines at the rising edges and falling edges, the power consumption in the gate driving circuits are also heightened.

In the active matrix LCD, a voltage charged in a liquid crystal cell is influenced by the kickback voltage (or feed through voltage, ΔVp) generated due to the parasitic capacitance of the TFT. The kickback voltage ΔVp is given by the following equation (1)

$$\Delta Vp = \frac{Cgd}{Clc + Cst + Cgd}(VGH - VGL) \quad (1)$$

Where 'Cgd' denotes a parasitic capacitance generated between a gate terminal of the TFT connected to the gate line and a drain terminal of the TFT connected to the pixel electrode of the liquid crystal cell, and 'VGH-VGL' denotes a voltage difference between the gate high voltage and the gate low voltage supplied to the gate line.

This kickback voltage alters voltages applied to the pixel electrodes of the liquid crystal cells to show flickers and afterimages in a displayed image. In order to reduce the kickback voltage ΔVp, there is used a gate pulse modulation method of modulating the gate high voltage VGH at the falling edge of the gate pulse. However, the gate pulse modulation method is for reducing the kickback voltage ΔVp, but has a limitation in reducing the power consumption.

SUMMARY

Embodiments of this document provide a display device and a method of controlling gate pulses capable of reducing the kickback voltage ΔVp and the power consumption.

According to an exemplary embodiment of this document, there is provided a display device comprising a display panel including data lines and gate lines intersecting each other, a data driving circuit configure to convert digital video data into data voltages which are supplied to the data lines, a gate driving circuit configure to sequentially supply gate pulses to the gate lines.

Here, a voltage of each of the gate pulses increases from a gate low voltage to a precharging voltage during a first rising time and thereafter increases from the precharging voltage to a gate high voltage during a second rising time, and the voltage of each of the gate pulses decreases from the gate high voltage to the precharging voltage during a first falling time and thereafter decreases from the precharging voltage to the gate low voltage during a second falling time.

According to an exemplary embodiment of this document, there is provided a method for controlling gate pulses comprising increasing voltages of the gate pulses from a gate low voltage to a precharging voltage during a first rising time, increasing the voltages of the gate pulses from the precharging voltage to a gate high voltage during a second rising time, decreasing the voltages of the gate pulses from the gate high voltage to the precharging voltage during a first falling time, and decreasing the voltages of the gate pulses from the precharging voltage to the gate low voltage during a second falling time.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1:
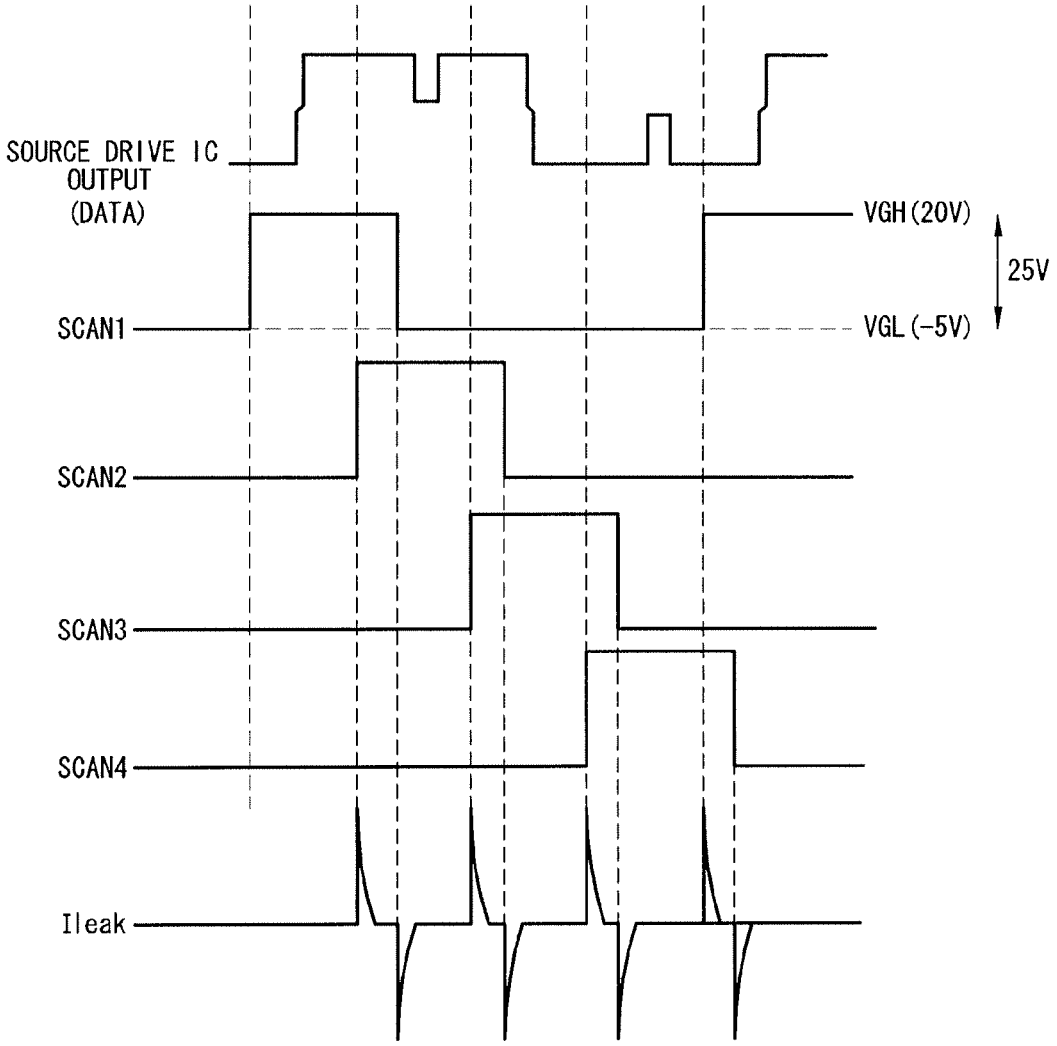
FIG. 1 (RELATED ART)
FIG. 1 is a waveform diagram illustrating data voltages and gate pulses for an LCD.

A display device according to this document comprises any display device which sequentially supplies gate pulses (or scan pulses) to the gate lines to write video data in the pixels in a line sequential scanning manner. For example, the display device may include, but not limited to, a liquid crystal display (LCD), an organic light emitting diode (OLED) display, a field emission display (FED), an electrophoresis display (EPD), or the like.

An LCD according to this document may be implemented by an liquid crystal mode such as a TN (Twisted Nematic) mode, a VA (Vertical Alignment) mode, an IPS (In Plane Switching) mode, an FFS (Fringe Field Switching) mode, or the like. The LCD according to this document may be implemented by the normally white mode or the normally black mode when classified by the transmittance to voltage characteristics. In addition, the LCD may be implemented by any types such as a transmissive LCD, a transflective LCD, and a reflective LCD or the like.

Embodiments according to this document will be described in detail mainly based on an LCD with reference to the accompanying drawings. The display device according to this document is exemplified by an LCD in the following description of the embodiments, but it is noted not to be limited to the LCD. Like reference numerals designate like elements throughout the specification. In the following description, when a detailed description of well-known functions or configurations related to this document is determined to unnecessarily cloud a gist of the present invention, the detailed description thereof will be omitted.

Names of the respective elements used in the following description are selected for convenience of writing the specification and may be thus different from those in actual products.

Figure 2:
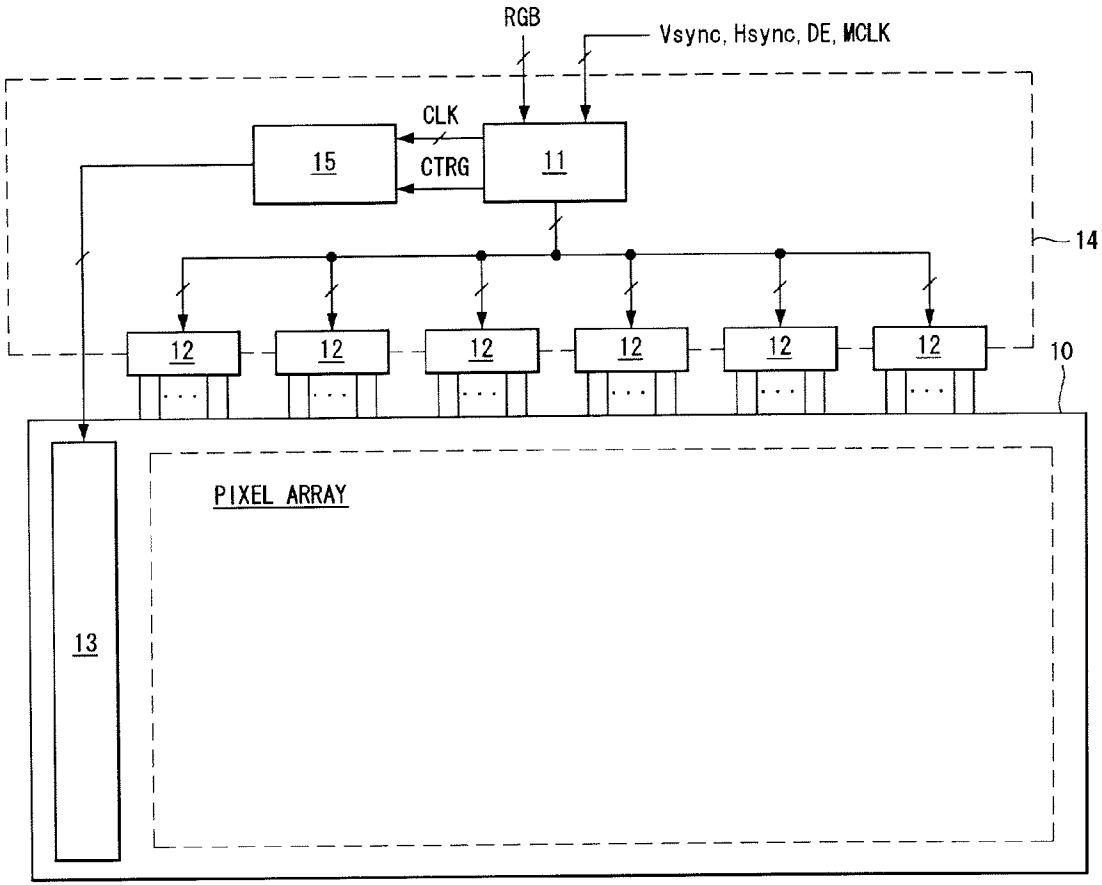
FIG. 2 is a block diagram illustrating a display device according to an embodiment of this document.

Referring to FIG. 2, the display device comprises a display panel assembly 10, a data driving circuit, a gate driving circuit, and a timing controller 11, and the like.

Figure 3:
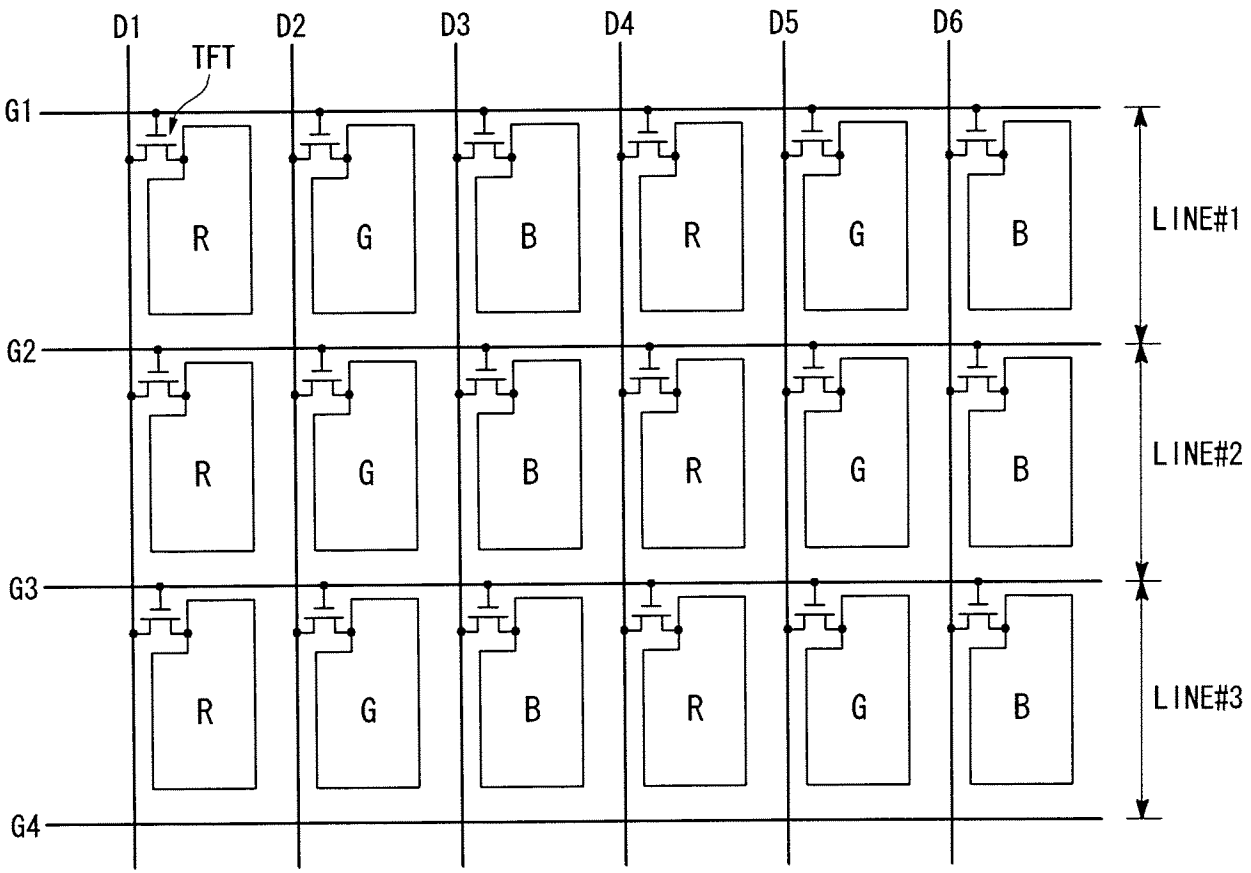
FIGS. 3 to 5 are equivalent circuit diagrams illustrating various examples of the TFT arrays formed in the display panel assembly shown in FIG. 2.
Figure 4:
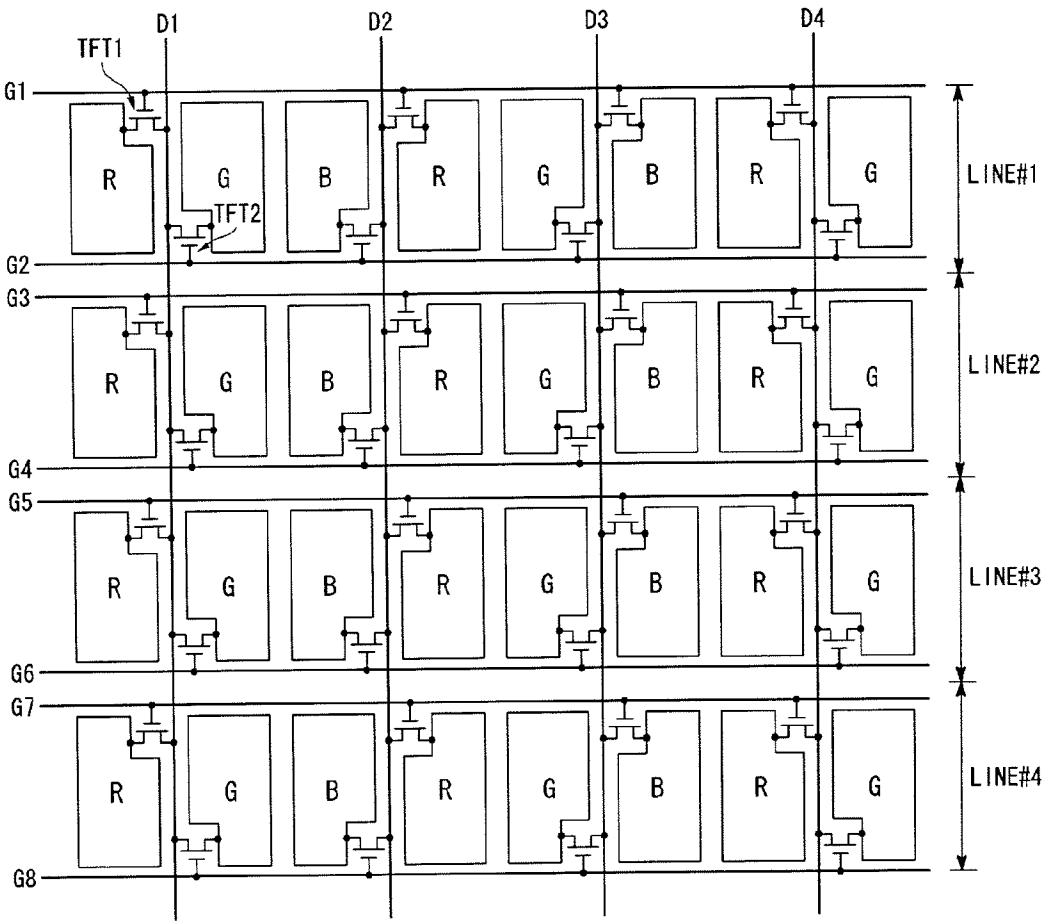
Figure 5:
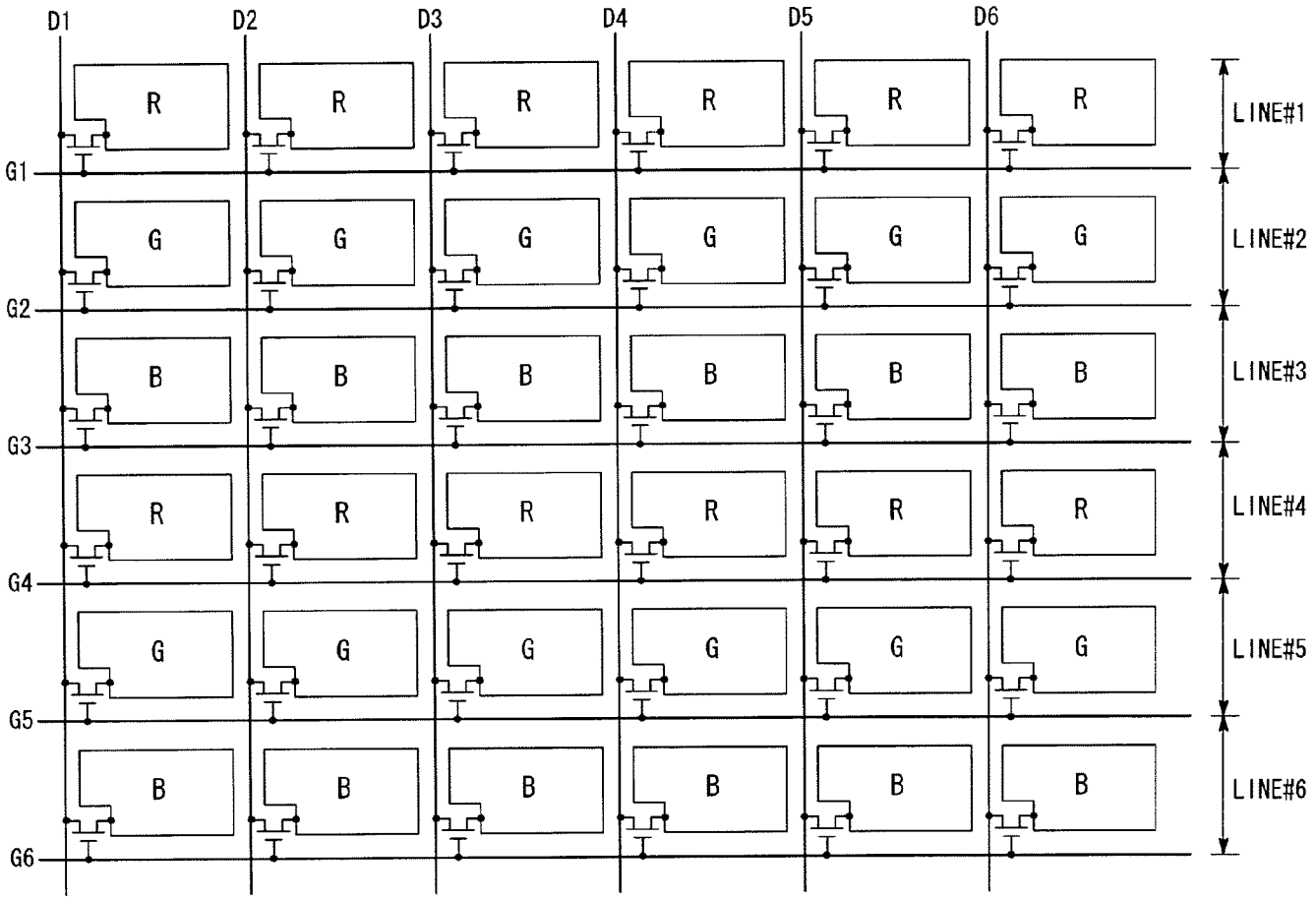

The display panel assembly 10 has a liquid crystal layer formed between two panels. A lower panel of the display panel assembly 10 is provided with, as shown in FIGS. 3 to 5, a TFT array including data lines, gate lines intersecting the data lines, TFTs formed at the respective intersections of the data lines and the gate lines, liquid crystal cells connected to the TFTs and driven by electric fields between pixel electrodes and common electrodes, and storage capacitors. An upper panel of the display panel assembly 10 is provided with a color filter array including black matrices and color filters. The common electrodes are disposed on the upper panel in a vertical electric field driving type such as the TN mode and the VA mode, and are disposed on the lower panel along with the pixel electrodes in a horizontal electric field type such as the IPS mode and the FFS mode. Polarizers are respectively attached to the outer surfaces of the lower and upper panel of the display panel assembly 10. In addition, alignment layers are formed on the inner surfaces having contact with the liquid crystal layer to set pretilt angles of the liquid crystal layer.

The display panel assembly 10 may be implemented by any one display panel assembly of an organic light emitting diode (OLED) display, a field emission display (FED), and an electrophoresis display (EPD).

The data driving circuit comprises a plurality of source drive ICs 12. The source drive ICs 12 receive digital video data RGB from the timing controller 11. The source drive ICs 12 convert the digital video data RGB into positive/negative analog data voltages, in response to source timing control signals from the timing controller 11, and supply the data voltages for the data lines in the display panel assembly 10 in synchronization with the gate pulses. The source drive ICs 12 may be connected to the data lines in the display panel assembly 10 by a COG (chip on glass) process or a TAB (tape automated bonding) process. FIG. 2 shows an example where the source drive ICs are mounted on tape carrier packages (TCPs), and joined to a printed circuit board (PCB) 14 and the lower panel of the display panel assembly 10 by the TAB scheme.

The gate driving circuit comprises a power sharing level shift circuit (hereinafter, referred to as a "level shifter") 15 and a shift register 13 connected between the timing controller 11 and the gate lines in the display panel assembly 10.

The level shifter 15 level-shifts a TTL (transistor transistor logic) level voltage of gate shift clocks CLK output from the timing controller 11, to have the gate high voltage VGH and the gate low voltage VGL. The gate shift clocks CLK are input to the level shifter 15 as i-phase (where i is a positive integer equal to or more than 2) clocks having a predetermined phase difference. The level shifter 15 reduces the power consumption and the kickback voltage $\Delta Vp$ through the power sharing at rising edges and falling edges of the level-shifted clocks having the gate high voltage VGH and the gate low voltage VGL. The shift register 13 shifts the clocks output from the level shifter 15 to sequentially supply the gate pluses to the gate lines in the display panel assembly 10.

The gate driving circuit may be directly formed on the lower panel of the display panel assembly 10 by a GIP (gate in panel) scheme, or may be connected between the gate lines in the display panel assembly 10 and the timing controller 11 by the TAB scheme. By the GIP scheme, the level shifter 15 may be mounted on the PCB 14, and the shift register 13 may be formed on the lower panel of the display panel assembly 10. By the TAB scheme, the level shifter and the shift register may be integrated into a single chip, mounted on the TCPs, and attached to the lower panel of the display panel assembly 10.

The timing controller 11 receives the digital video data RGB from an external device via an interface such as an LVDS (low voltage differential signaling) interface, a TMDS (transition minimized differential signaling) interface or the like. The timing controller 11 transmits the digital video data from the external device to the source drive ICs 12.

The timing controller 11 receives timing signals such as a vertical synchronizing signal Vsync, a horizontal synchronizing signal Hsync, a data enable signal DE, a main clock MCLK, and so forth, from the external device via an LVDS or TMDS interface reception circuit. The timing controller 11 generates timing control signals for controlling operation timings of the data driving circuit and the gate driving circuit with respect to the timing signals from the external device. The timing control signals include gate timing control signals for controlling operation timings of the gate driving circuit, and data timing signals for controlling operation timings of the source drive ICs 12 and polarities of the data voltages.

The gate timing control signals include a gate start pulse GSP, the gate shift clocks CLK, a gate output enable signal GOE, and so forth. The gate start pulse GSP is input to the shift register 13 to control shift start timings. The gate shift clocks CLK are input to the level shifter 15 and level-shifted, which are then input to the shift register 13, and are used as clock signals for shifting the gate start pulse GSP. The gate output enable signal GOE controls output timings of the shift register 13.

The data timing control signals include a source start pulse SSP, a source sampling clock SSC, a polarity control signal POL, a source output enable signal SOE, and so on. The source start pulse SSP controls shift start timings in the source drive ICs 12. The source sampling clock SSC is a clock signal which controls data sampling timings with respect to a rising edge or a falling edge in the source drive ICs 12. The polarity control signal POL controls polarities of the data voltages output from the source drive ICs 12. If a data transmission interface between the timing controller 11 and the source drive ICs 12 is a mini LVDS interface, the source start pulse SSP and the source sampling clock SSC may be omitted.

The timing controller 11 supplies i gate shift clocks CLK which swing in the TTL level and of which the phases are sequentially delayed, and a power sharing control signal CTRG, to the level shifter 15.

FIGS. 3 to 5 are equivalent circuit diagrams illustrating various examples of the TFT array.

In the TFT array shown in FIG. 3, red subpixels R, green subpixels G, and blue subpixels B are respectively arranged in the column direction. The respective TFTs transmit data voltages from the data lines D1 to D6 to the pixel electrodes of the liquid crystal cells disposed at the left (or right) of the data lines D1 to D6, in response to the gate pulses from the gate lines G1 to G4. In the TFT array shown in FIG. 3, one pixel comprises a red subpixel R, a green subpixel G, and a blue subpixel B adjacent to each other in the row direction (or line direction) perpendicular to the column direction. When the resolution of the TFT array shown in FIG. 3 is m×n, m×3 (where 3 is RGB) data lines and n gate lines are necessary.

In the TFT array shown in FIG. 4, since the subpixels adjacent to each other in the line direction share the same data line, it is possible to reduce the number of the data lines D1 to D4 needed in the same resolution by half as compared with the TFT array shown in FIG. 3, and also reduce the number of the needed source drive ICs by half. In this TFT array, the red subpixels R, the green subpixels G, and the blue subpixels B are respectively arranged in the column direction. One pixel in the TFT array shown in FIG. 4 comprises a red subpixel R, a green subpixel G, and a blue subpixel B adjacent to each other in the line direction perpendicular to the column direction. Two liquid crystal cells adjacent to each other in the line direction share the same data line to charge data voltages transmitted along the data line therein. When the liquid crystal cells and the TFTs disposed at the left of each of the data lines D1 to D4 are assumed to be first liquid crystal cells and first TFTs TFT1, and the liquid crystal cells and the TFTs disposed at the right of each of the data lines D1 to D4 are assumed to be second liquid crystal cells and second TFTs TFT2, a connection relation between the TFTs TFT1 and TFT2 will be described. The first TFTs TFT1 transmit the data voltages from the data lines D1 to D4 to the pixel electrodes of the first liquid crystal cells in response to the gate pulses from the odd numbered gate lines G1, G3, G5 and G7. Gate terminals of the first TFTs TFT1 are connected to the odd numbered gate lines G1, G3, G5 and G7, and drain terminals thereof are connected to the data lines D1 to D4. Source electrodes of the first TFTs TFT1 are connected to the pixel electrodes of the first liquid crystal cells. The second TFTs TFT2 transmit the data voltages from the data lines D1 to D4 to the pixel electrodes of the second liquid crystal cells in response to the gate pulses from the even numbered gate lines G2, G4, G6 and G8. Gate terminals of the second TFTs TFT2 are connected to the even numbered gate lines G2, G4, G6 and G8, and drain terminals thereof are connected to the data lines D1 to D4. Source electrodes of the second TFTs TFT2 are connected to the pixel electrodes of the second liquid crystal cells.

In the TFT array shown in FIG. 5, since the subpixels of the same color are arranged in the row direction, it is possible to reduce the number of the data lines needed in the same resolution to a third as compared with the TFT array shown in FIG. 3, and also reduce the number of the needed source drive ICs to a third. In this TFT array, the red subpixels R, the green subpixels G, and the blue subpixels B are respectively arranged in the line direction. One pixel in the TFT array shown in FIG. 5 comprises a red subpixel R, a green subpixel G, and a green subpixel G adjacent to each other in the column direction. In response to the gate pulses from the gate lines G1 to G6, the respective TFTs transmit the data voltages from the data lines D1 to D6 to the pixel electrodes of the liquid crystal cells disposed at the left (right) of each of the data lines D1 to D6.

The TFT arrays shown in FIGS. 3 to 5 are a portion of examples of TFT arrays which can be applied to this document, and thus they are not limited thereto but may be modified in various ways based on panel driving characteristics. For example, a TFT array of the OLED display may comprises two or more TFTs including a switch TFT and a driving TFT for each pixel. Also, the TFT arrays shown in FIGS. 3 to 5 may embed a touch sensor circuit or an image sensor circuit therein and may further comprise TFTs needed to the sensor circuits. Therefore, a TFT array in this document is not limited to those shown in FIGS. 3 to 5. The present Applicant has described in detail the TFT array which embeds an optical sensor therein and has a touch sensor function and an image sensor function in a plurality of published documents such as Korean Unexamined Patent Application Publication No. 10-2009-0120096 (Nov. 24, 2009), Korean Unexamined Patent Application Publication No. 10-2009-0058888 (Jun. 10, 2009), Korean Unexamined Patent Application Publication No. 10-2008-0020860 (Mar. 6, 2008), Korean Unexamined Patent Application Publication No. 10-2007-0063263 (Jun. 19, 2007), and the like.

Figure 6:
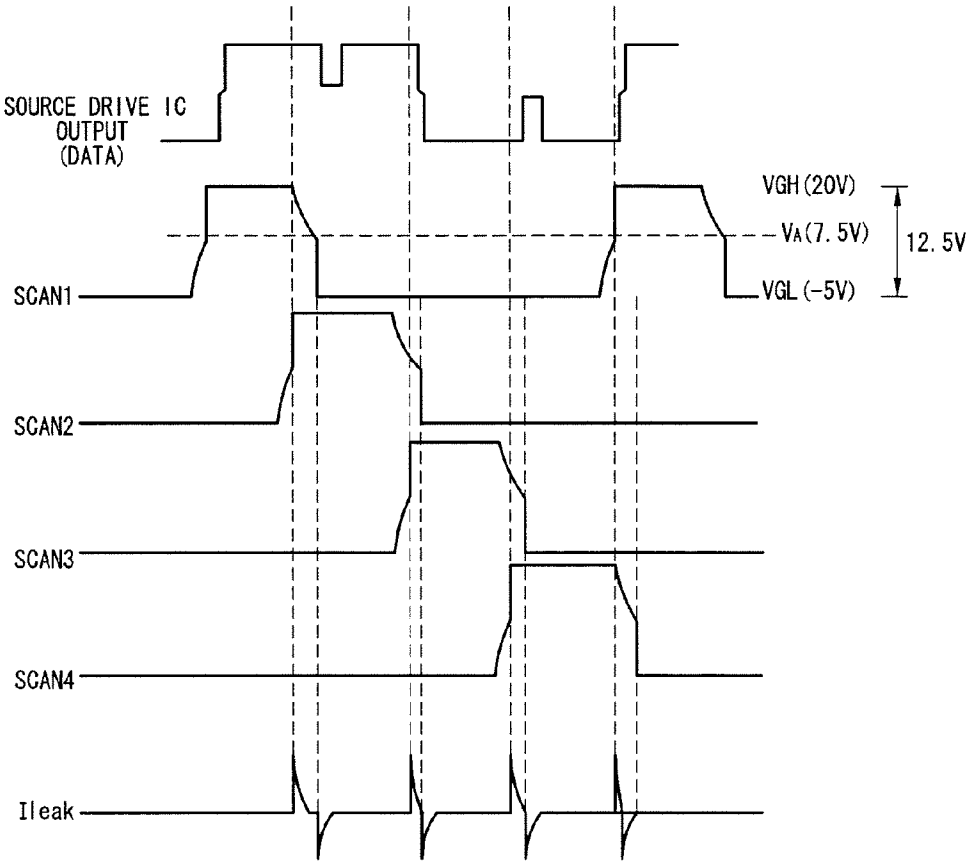
FIG. 6 is a waveform diagram illustrating data voltages and gate pulses according to an embodiment of this document.

FIG. 6 is a waveform diagram illustrating data voltages output from the source drive ICs 12 and gate pulses output from the level shifter 15.

In FIG. 6, the level shifter 15 precharges an output node through the power sharing at the rising edge of each of the gate pulses SCAN1 to SCAN4 up to a predetermined precharging voltage $V_A$ and then charges it to the gate high voltage VGH. The precharging voltage $V_A$ is higher than the gate low voltage VGL and is lower than the gate high voltage VGH and may be appropriately selected in consideration of the characteristics of the display panel assembly 10, the power consumption, and the kickback voltage ΔVp. In FIG. 6, the precharging voltage $V_A$ is exemplified as a medium voltage between the gate low voltage VGL and the gate high voltage VGH, and can be adjusted. A pull-up transistor of the level shifter 15 is turned on to enable a voltage at the output node to be charged to the gate high voltage VGH after the voltage at the output node is charged to the precharging voltage $V_A$. Since the voltage at the output node of the level shifter 15 varies from the precharging voltage $V_A$ to the gate high voltage VGH at the rising edge of each of the gate pulses SCAN1 to SCAN4, its swing range is greatly reduced as compared with that in the related art. Therefore, the current Ileak in the level shifter 15 is also greatly reduced at the rising edge of each of the gate pluses SCAN1 to SCAN4 as compared with that in the related art, and the kickback voltage in the display panel assembly 10 ΔVp is lowered.

The level shifter 15 discharges the output node through the power sharing at the falling edge of each of the gate pulses SCAN1 to SCAN4 to a predetermined precharging voltage $V_A$ and then discharges it to the gate low voltage VGL. A pull-down transistor of the level shifter 15 is turned on to enable a voltage at the output node to be discharged to the gate low voltage VGL after the voltage at the output node is discharged to the precharging voltage $V_A$. Since the voltage at the output node discharged via the pull-down transistor varies from the precharging voltage $V_A$ to the gate low voltage VGL at the falling edge of each of the gate pulses SCAN1 to SCAN4, its swing range is greatly reduced as compared with that in the related art. Therefore, the current Ileak flowing through the output node at the falling edge of each of the gate pulses SCAN1 to SCAN4 is also greatly reduced as compared with that in the related art, and the kickback voltage in the display panel assembly 10 ΔVp is lowered.

Figure 7:
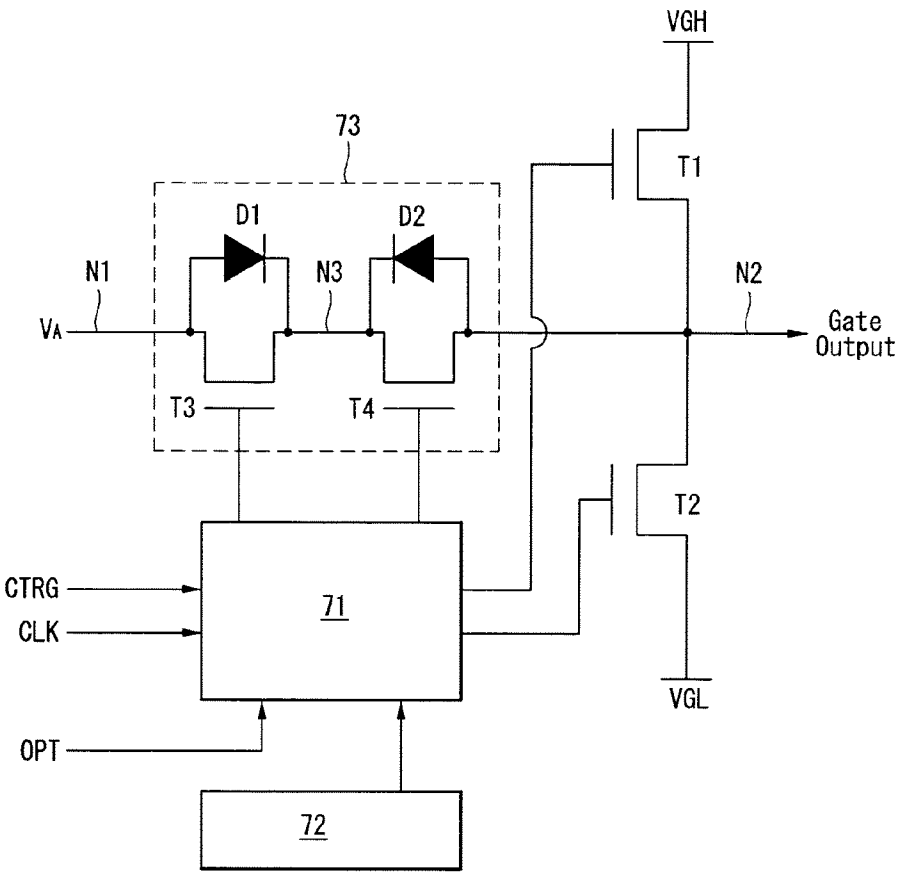
FIG. 7 is a circuit diagram illustrating a level shifter according to a first embodiment of this document.

FIG. 7 is a circuit diagram illustrating the level shifter 15 according to a first embodiment of this document.

Referring to FIG. 7, the level shifter 15 comprises a first node N1 applied with a precharging voltage, a second node N2 applied with the gate pulses SCAN1 to SCAN3, a power sharing switch circuit 73 connected between the first node N1 and the second node N2, a first transistor T1 applied with the gate high voltage VGH, a second transistor T2 applied with the gate low voltage VGL, a switch controller 71 connected to the power sharing switch circuit 73 and the first and second transistors T1 and T2, and a delay circuit 72 connected to the switch controller 71. The first node N1 is an input node of the level shifter 15 and the node N2 is an output node of the level shifter 15.

The first transistor T1, which is a pull-up transistor, is turned on to transmit the gate high voltage VGH to the second node N2 after a voltage at the second node N2 is charged to the precharging voltage $V_A$ at the rising edge duration of the gate pulse under the control of the switch controller 71. A gate terminal of the first transistor T1 is connected to a first control signal output node of the switch controller 71, and a source terminal thereof is connected to the second node N2. A drain terminal of the first transistor T1 is applied with the gate high voltage VGH.

The second transistor T2, which is a pull-down transistor, is turned on to transmit the gate low voltage VGL to the second node N2 after a voltage at the second node N2 is discharged to the precharging voltage $V_A$ at the falling edge duration of the gate pulse under the control of the switch controller 71. A gate terminal of the second transistor T2 is connected to a second control signal output node of the switch controller 71, and a drain terminal thereof is connected to the second node N2. A source terminal of the second transistor T2 is applied with the gate low voltage VGL.

The power sharing switch circuit 73 comprises first and second diodes D1 and D2, and third and fourth transistors T3 and T4 controlled by the switch controller 71.

The first diode D1 is turned on at an initial period of time in the rising edge duration of the gate pulse to form a current path between the first node N1 and a third node N3. The third transistor T3 is turned on to from a current path at an initial period of time in the falling edge duration of the gate pulse under the control of the switch controller 71. A gate terminal of the third transistor T3 is connected to a third control signal output node of the switch controller 71, and a source terminal thereof is connected to an anode of the first diode D1. The source terminal of the third transistor T3 is applied with the precharging voltage $V_A$. A drain terminal of the third transistor T3 is connected to a cathode of the first diode D1 and a drain of the fourth transistor T4 via the third node N3.

The second diode D2 is turned on at an initial period of time in the falling edge duration of the gate pulse to form a current path between the second node N2 and the third node N3. The fourth transistor T4 is turned on to form a current path between the second node N2 and the third node N3 at an initial period of time in the rising edge duration of the gate pulse under the control of the switch controller 71. A gate terminal of the transistor T4 is connected to a fourth control signal output node of the switch controller switch controller 71, and a source terminal thereof is connected to an anode of the second diode and the second node N2. The drain terminal of the fourth transistor T4 is connected to the third node N3.

The first to fourth transistors T1 to T4 may be implemented by an n type MOSFET (metal-oxide-semiconductor field-effect transistor). The first to fourth transistors T1 to T4 may be implemented by a p type MOSFET, not limited to the n type MOSFET, or may be implemented by CMOS (complementary metal semiconductor) transistor. Hereinafter, there will be description of exemplifying that the first to fourth transistors T1 to T4 are implemented by the n type MOSFET.

The switch controller 71 controls the transistors T1 to T4 in response to the gate shift clocks CLK and the power sharing control signal CTRG from the timing controller 11. The delay circuit 72 delays gate voltages for the transistors T1 to T4 using a delay circuit such as an RC delay circuit. A delay value in the delay circuit 72 may be adjusted based on a rising edge slope, a rising edge time, a falling edge slope, and a falling edge time of the gate pulse output from the level shifter 15.

Figure 8:
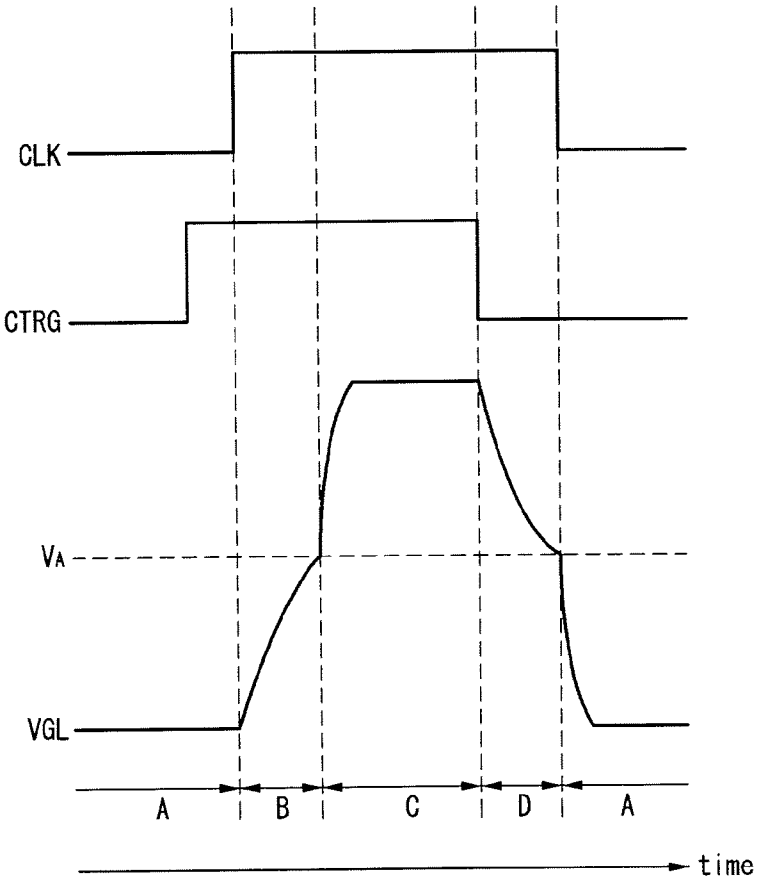
FIG. 8 is a waveform diagram illustrating waveforms of input and output of the level shifter shown in FIG. 7.

FIG. 8 is a waveform diagram illustrating input and output waveforms of the level shifter 15. FIGS. 9 to 12 are circuit diagrams sequentially illustrating operations of the level shifter 15.

Referring to FIGS. 8 to 12, an operation of the level shifter 15 may be divided into first to fourth times A to D.

The transistors T1 to T4 are operated as shown in Table 1 for each time zone under the control of the switch controller 71. The transistors T3 and T4 of the power sharing switch circuit 73 are connected between the first node N1 (input node) and the second node N2 (output node) under the control of the switch controller 71, to form a current path between the first node N1 and the second node N2 during the second time (or the first rising time) and the fourth time (or the first falling time) and to block the current path between the first node N1 and the second node N2 during the third time (or the second rising time) and the first time (or the second falling $_{time}$).

TABLE 1

| | T1 | T2 | T3 | T4 | Gate output |
|---|---|---|---|---|---|
| A | OFF | ON | OFF | OFF | VGL |
| B | OFF | OFF | OFF | ON | $V_A$ |
| C | ON | OFF | OFF | OFF | VGH |
| D | OFF | OFF | ON | OFF | $V_A$ |

Figure 9:
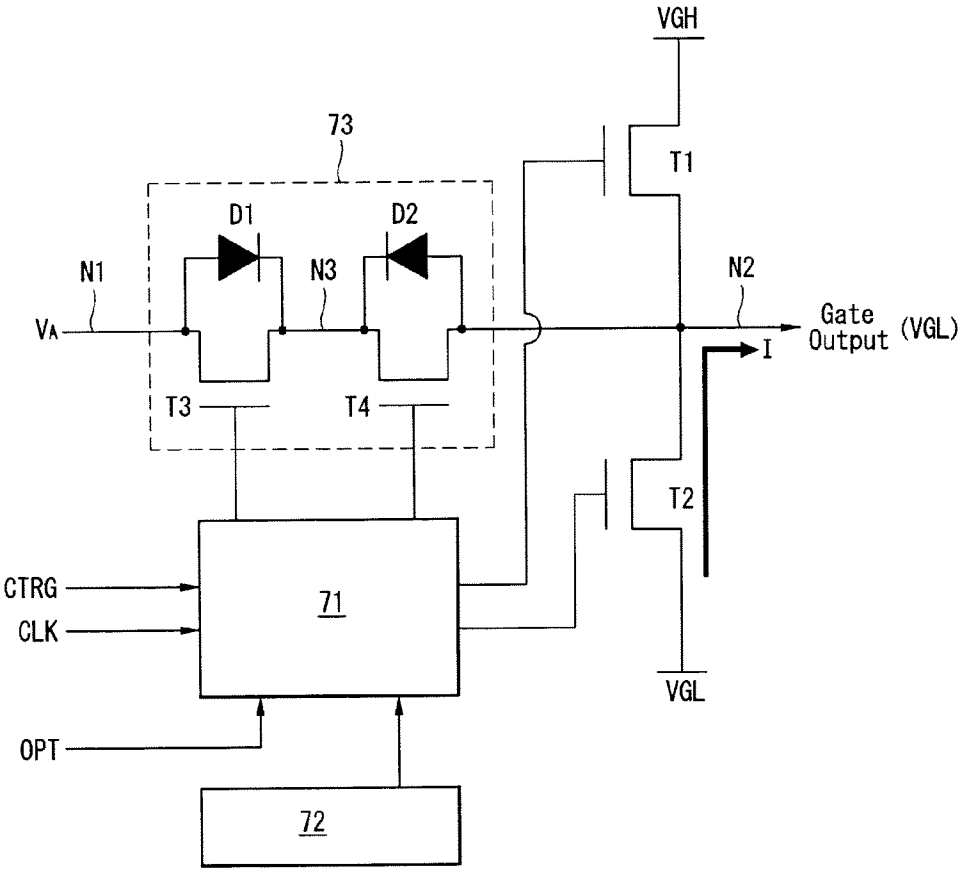
FIGS. 9 to 12 are circuit diagrams sequentially illustrating operations of the level shifter shown in FIG. 7.

The level shifter 15 maintains a voltage at the output node N2 as the gate low voltage VGL during the first time A. The switch controller 71 outputs a high logic voltage to the second control signal output node and outputs a low logic voltage to the first, third, and fourth control signal output nodes, regardless of the power sharing control signal CTRG till the gate shift clocks CLK are input. Thereby, the second transistor T2 is, as shown in FIG. 9, turned on during the first time A to maintain a voltage at the output node N2 of the level shifter 15 as the gate low voltage VGL. The first, third, and fourth transistors T1, T3 and T4 are turned off during the first time A.

Figure 10:
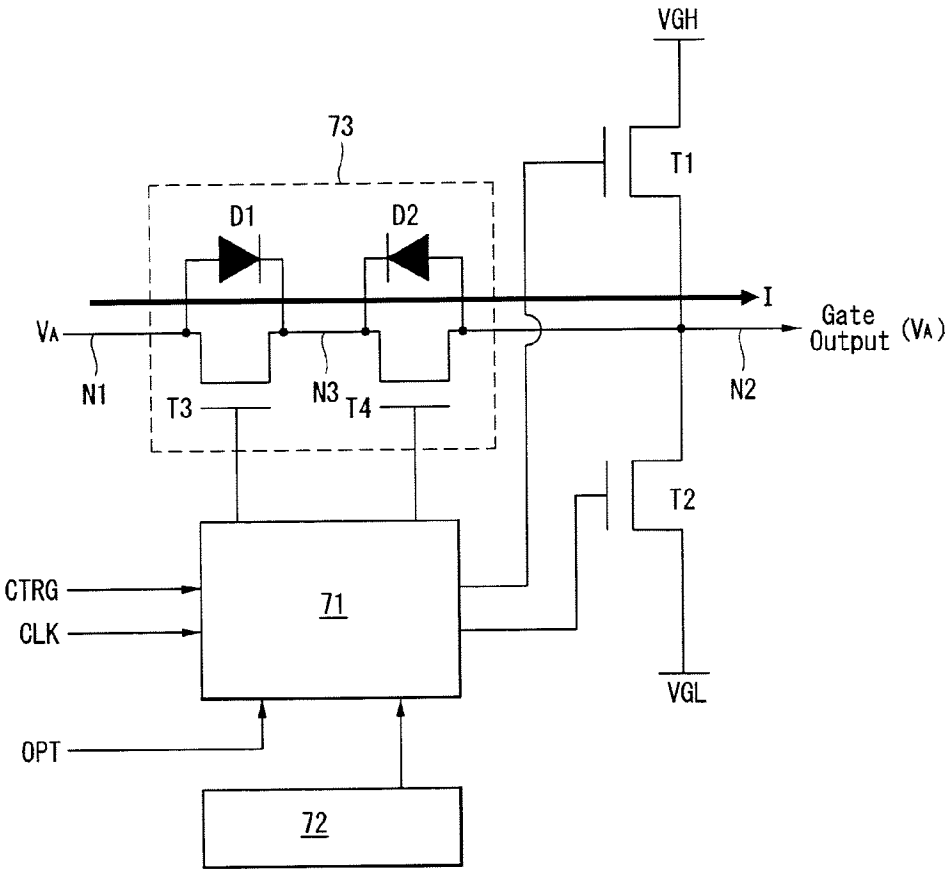

The level shifter 15 increases a voltage at the output node N2 from the gate low voltage VGL to the predetermined precharging voltage $V_A$ by using the power sharing switch circuit 73 during the second time B. The switch controller 71 outputs the high logic voltage to the fourth control signal output node and outputs the low logic voltage to the first, second, and third control signal output nodes in synchronization with the rising edge of the gate shift clock CLK, during the second time B when the power sharing control signal CTRG is maintained as the high logic voltage. Thereby, the fourth transistor T4 is, as shown in FIG. 10, turned on during the second time B to form a current path between the third node N3 and the output node N2. During the second time B, the precharging voltage $V_A$ is charged in the output node N2 along the current path formed via the input node N1, the first diode D1, the third node N3, and the fourth transistor T4. A voltage at the fourth control signal output node, that is, the gate voltage for the transistor T4 may be delayed in accordance with a delay value in the delay circuit 72. Therefore, a slope of increase in the voltage at the output node may be adjusted based on the delay value in the delay circuit 72. The first to third transistors T1 to T3 are turned off during the second time B.

Figure 11:
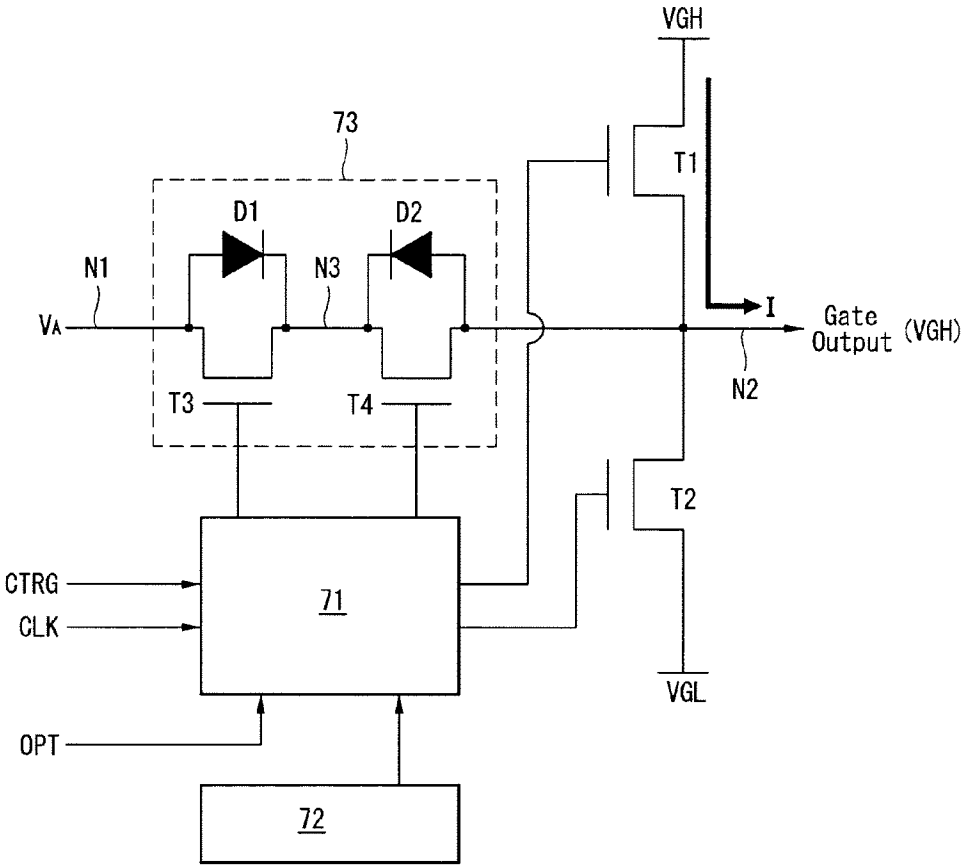

The level shifter 15 maintains a voltage at the output node N2 as the gate high voltage VGH during the third time C. The switch controller 71 outputs the high logic voltage to the first control signal output node and outputs the low logic voltage to the second and fourth control signal output nodes, during the third time C when the power sharing control signal CTRG and the gate shift clock CLK are maintained as the high logic voltage. Thereby, the first transistor T1 is, as shown in FIG. 11, turned on at the same time as the start of the third time C to increase a voltage at the output node N2 from the precharging voltage $V_A$ to the gate high voltage VGH and thereafter to maintain the voltage at the output node N2 as the gate high voltage VGH during the third time C. The second to fourth transistors T2, T3 and T4 are turned off during the third time C.

Figure 12:
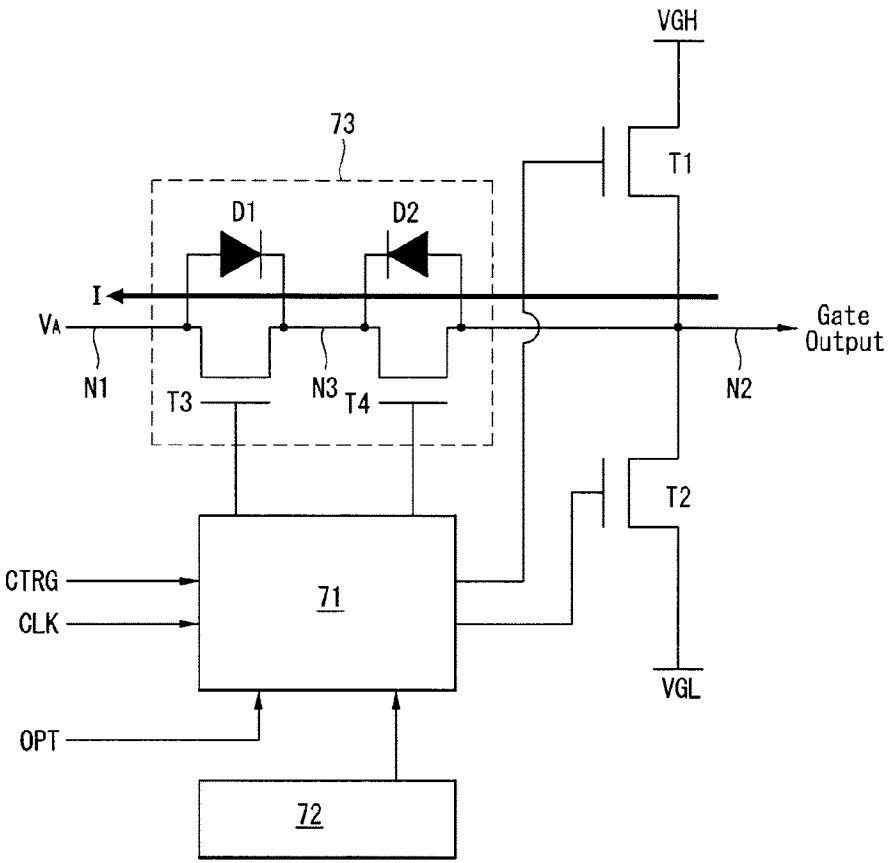

The level shifter 15 discharges the voltage at the output node N2 from the gate high voltage VGH to the precharging voltage $V_A$ by using the power sharing switch circuit 73 during the fourth time D. The switch controller outputs the high logic voltage to the third control signal output node and outputs the low logic voltage to the first, second, and fourth control signal output nodes in synchronization with the falling edge of the power sharing control signal CTRG, during the fourth time D when the gate shift clock is maintained as the high logic voltage and the power sharing control signal CTRG is reversed to the low logic voltage. Thereby, the third transistor T3 is, as shown in FIG. 12, turned on during the fourth time D to form a current path between the input node N1 and the third node N3. During the fourth time D, a voltage at the output node N2 is discharged along a current path formed via the second diode D2, the third node N3, the third transistor T3, and the input node N1 to be lowered to the precharging voltage $V_A$. A voltage at the third control signal output node, that is, the gate voltage of the third transistor T3 may be delayed in accordance with a delay value in the delay circuit 72. Therefore, during the fourth time D, a slope of decrease in the voltage at the output node may be adjusted based on the delay value in the delay circuit 72. The first, second, and fourth transistors T1, T2 and T4 are turned on during the fourth time D.

Figure 13:
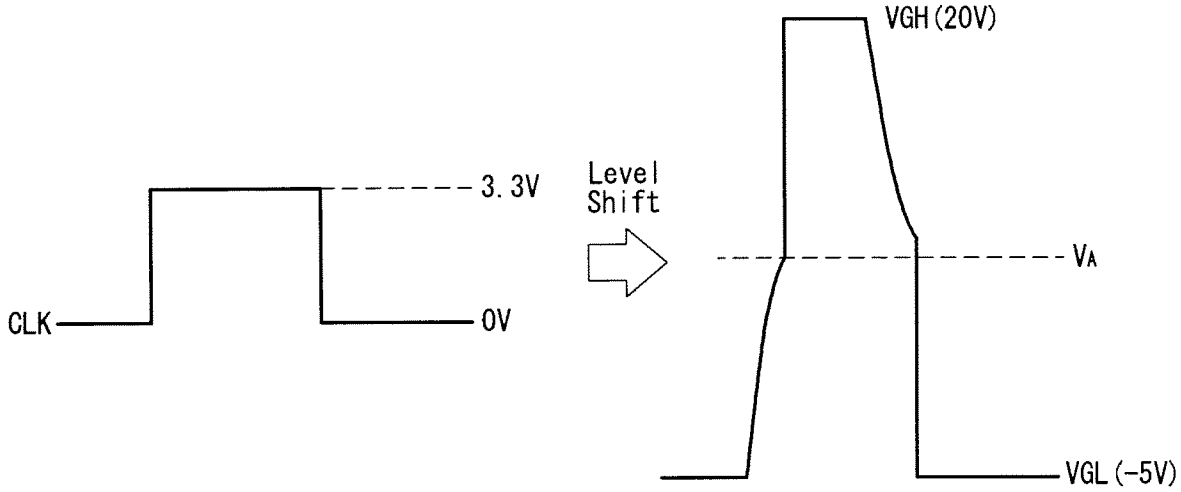
FIG. 13 is a waveform diagram illustrating input and output waveforms of the level shifter shown in FIG. 7.

Thereafter, the level shifter 15 level-shifts the gate pluses by repeatedly performing the operations shown in FIGS. 9 to 12. FIG. 13 is a waveform diagram illustrating an input clock CLK and an output clock (gate output) of the level shifter 15.

The inflection point in the waveform of the rising edge of the gate pulse is placed at the boundary between the second time B and the third time C. The inflection point in the waveform of the falling edge of the gate pulse is placed at the boundary between the fourth time D and the first time A. The slope of the rising edge of the gate pulse at the second time B may be controlled to be smaller than that at the rising edge of the third time C. The slope of the falling edge at the fourth time D may be controlled to be smaller than that at the falling edge of the first time A thereafter. In addition, the voltage at the second time B in the rising edge of the gate pulse may be increased in a step waveform shape, and the voltage at the fourth time B in the falling edge of the gate pulse may be decreased in a step waveform shape.

The switch controller 71 may be provided with an option terminal OPT. The switch controller 71 may select the power sharing at the second time B and the power sharing at the fourth time D depending on a logic voltage value at the option terminal OPT. The option terminal OPT may be applied with a power supply voltage Vcc or a ground voltage GND via a switching element such as a dip switch formed on the PCB 14. Also, the option terminal OPT may be connected to the timing controller 11. Thus, the timing controller or an operator of fabricating the display device can select voltages applied to the option terminal to select the power sharing operation of the level shifter 15.

For example, if a logic value at the option terminal OPT is "00," the switch controller 71 controls the first and second transistors T1 and T2 as shown in Table 1, and disables the third and fourth transistors T3 and T4 to makes the power sharing at the second and fourth times B and D inactive. If a logic value at the option terminal OPT is "01," the switch controller 71 controls the first, second, and third transistors T1, T2 and T3 as shown in Table 1, and disables the fourth transistor T4 to make the power sharing at the second time B inactive. If a logic value at the option terminal OPT is "10," the switch controller 71 controls the first, second, and fourth transistors T1, T2 and T4 as shown in Table 1, and disables the third transistor T3 to make the power sharing at the fourth time D inactive. If a logic value at the option terminal OPT is "11," the switch controller 71 controls the first to fourth transistors T1 to T4 to make the power sharing at the second and fourth times B and D active.

Figure 14:
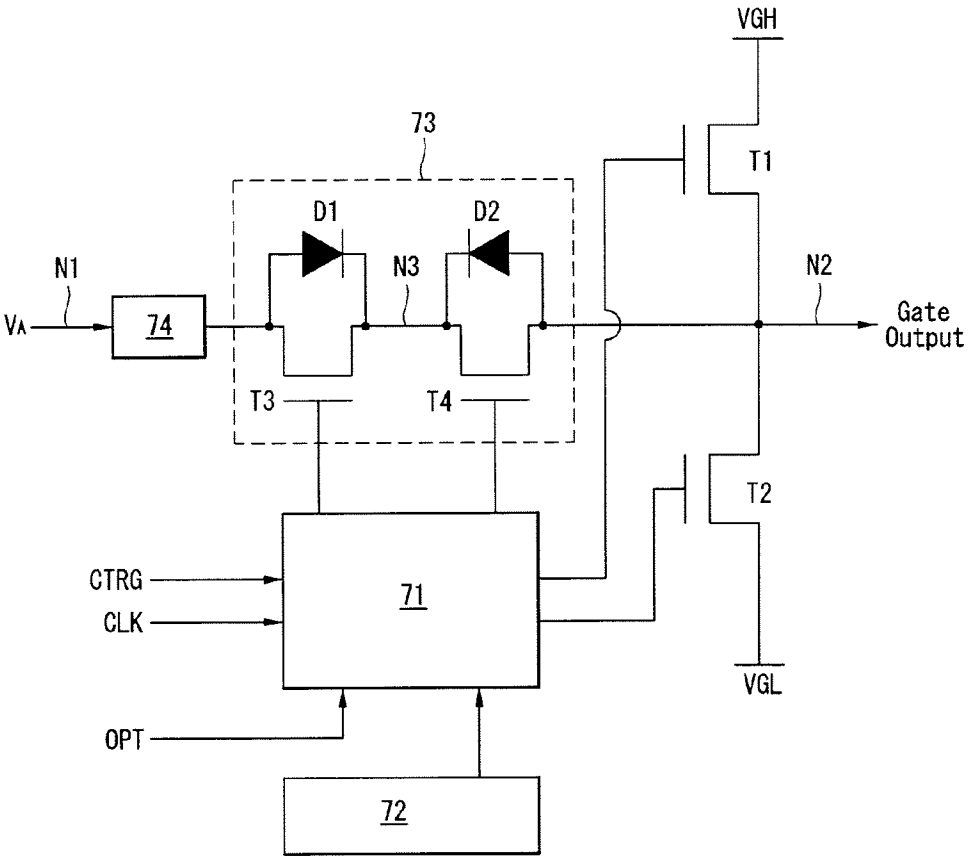
FIG. 14 is a circuit diagram illustrating a level shifter according to a second embodiment of this document.
Figure 15:
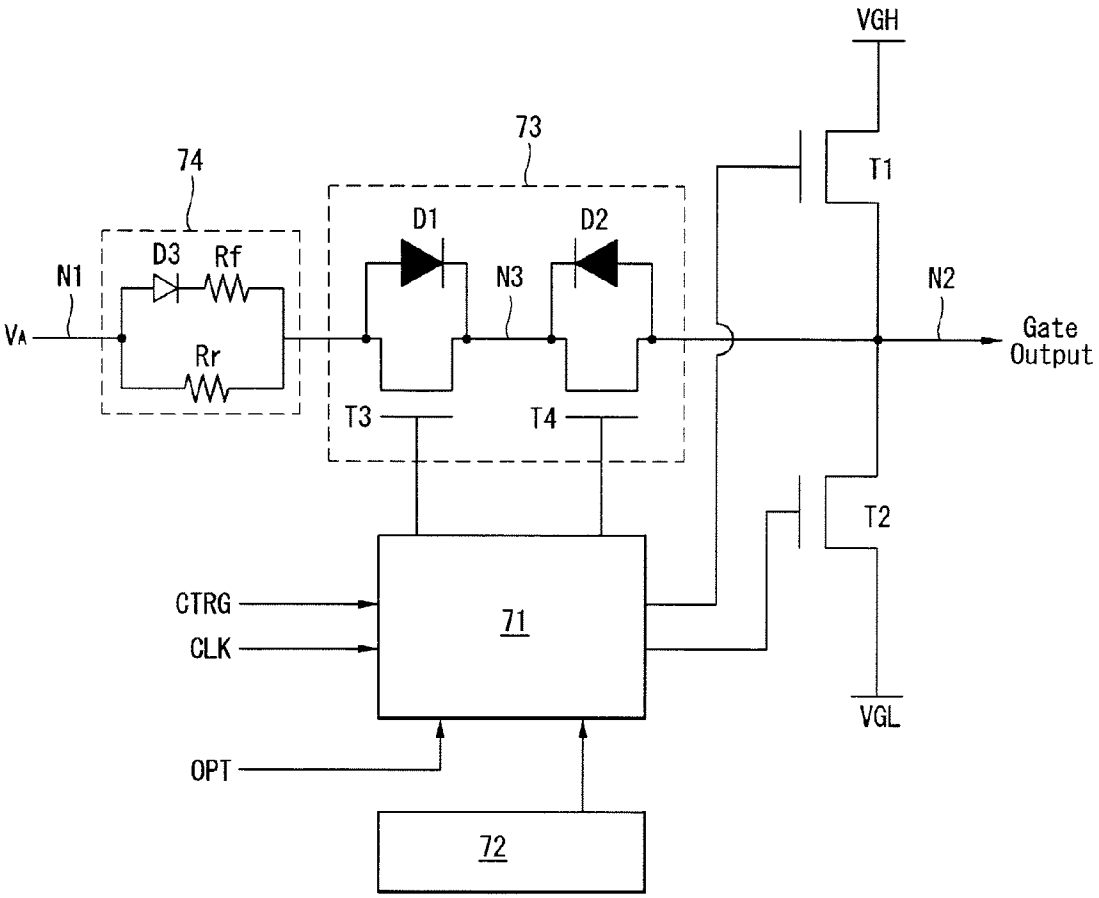
FIG. 15 is a circuit diagram illustrating an example of the power sharing waveform adjustment circuit shown in FIG. 14.

FIGS. 14 and 15 are circuit diagrams illustrating a level shifter 15 according to a second embodiment of this document.

In FIG. 14, the level shifter 15 comprises a power sharing switch circuit 73, a first transistor T1, a second transistor T2, the switch controller 71, a delay circuit 72, and a precharging voltage adjustment circuit 74. The power sharing switch circuit 73, the first transistor T1, the second transistor T2, the switch controller 71, and the delay circuit 72 are substantially the same as those in the above-described first embodiment, and thus the detailed description thereof will be omitted.

The precharging voltage adjustment circuit 74 is connected between the input node N1 of the level shifter 15 and the power sharing switch circuit 73 and adjusts a voltage level and a waveform at the output node N2 during the second and fourth times B and D. The precharging voltage adjustment circuit 74 may be implemented by a variety of circuits in order to adjust a voltage at the output node to a desired voltage level and form during the second and fourth times B and D.

The precharging voltage adjustment circuit 74 may comprise a parallel resistor circuit as shown in FIG. 15. The parallel resistor circuit comprises a third diode D3 and a first resistor Rf connected in series between the input node N1 and the power sharing switch circuit 73, and a second resistor Rr connected between the input node N1 and the power sharing switch circuit 73. An anode of the third diode D3 is connected to the input node N1, and a cathode thereof is connected to the first resistor Rf. Since the precharging voltage $V_A$ is charged in the output node N2 via the third diode D3 and the first resistor Rf during the second time B, a voltage level of the precharging voltage $V_A$ charged in the output node N2 during the second time B can be adjusted depending on a resistance value of the first resistor Rf. Since the voltage at the output node N2 is discharged via the second resistor Rr during the fourth time D, a voltage level at the output node N2 discharged during the fourth time D can be adjusted depending on a resistance value of the second resistor Rr.

Figure 18A:
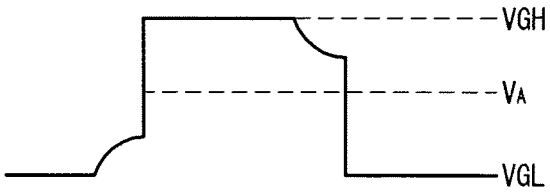
Figure 18B:
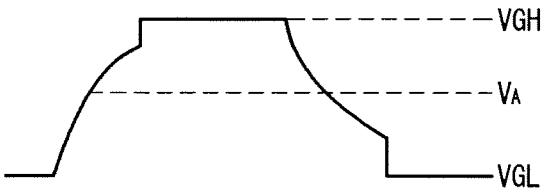

In the meantime, the maximum voltage at the second time B and the minimum voltage at the fourth time, that is, the precharging voltage $V_A$ may be set to be equal at the second time B and the fourth time D, whereas it may be set to be different at those times as shown in FIGS. 18A and 18B. For example, the precharging voltage $V_A$ at the second time B and the precharging voltage $V_A$ at the fourth time D are set to be different from each other, thereby controlling the maximum voltage at the second time B and the minimum voltage at the fourth time D to be different from each other. In another method, the maximum voltage at the second time B and the minimum voltage at the fourth time D can be controlled to be different from each other by adjusting the second time B and the fourth time D.

FIGS. 16A to 17B are waveform diagrams illustrating a variety of waveforms of the gate pulse output from the level shifter 15.

Figure 16A:
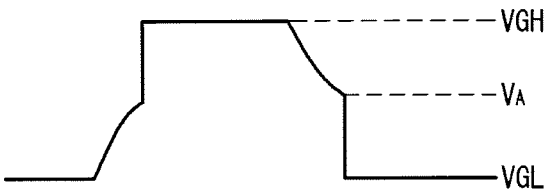
FIGS. 16A to FIG. 18B are waveform diagrams illustrating a variety of waveforms of the gate pulses output from the level shifter.
Figure 16B:
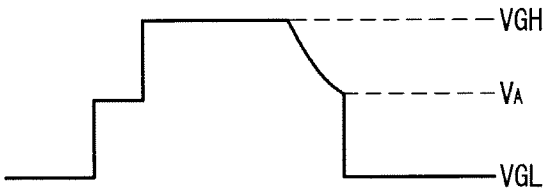
Figure 16C:
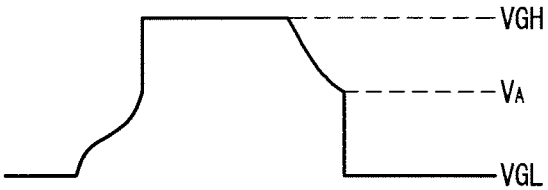
Figure 16D:
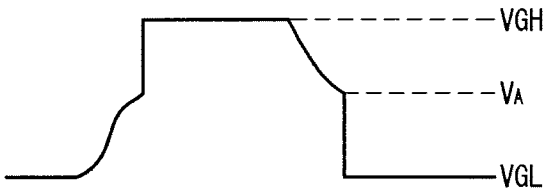

As shown in FIGS. 16A and 16B, a slope of a waveform increasing to the precharging voltage $V_A$ at the rising edge of the gate pulse output from the level shifter during the second time B can be adjusted based on a delay value in the delay circuit 72, and a value of precharging voltage $V_A$ can be adjusted using the precharging voltage adjustment circuit 74. For example, the slope of the rising edge waveform of the gate pulse during the second time B increases as the delay value in the delay value 72 becomes smaller, whereas it decreases as the delay value in the delay circuit 72 becomes greater. The precharging voltage $V_A$ of the gate pulse during the second time B can be adjusted depending on a resistance value of the first resistor Rf of the precharging voltage adjustment circuit 74. If the precharging voltage adjustment circuit 74 is constituted by switching elements for switching resonance waveforms with an LC resonance circuit, the rising edge waveform of the gate pulse increasing during the second time B can be controlled in a sinusoidal waveform, as shown in FIGS. 16C and 16D.

Figure 17A:
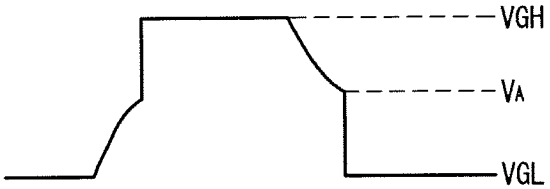
Figure 17B:
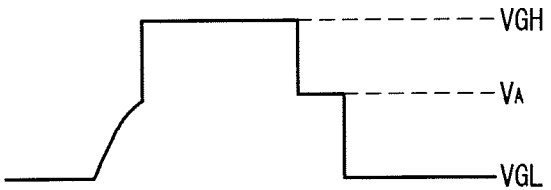

As shown in FIGS. 17A and 17B, a slope of a waveform decreasing to the precharging voltage $V_A$ at the falling edge of the gate pulse output from the level shifter 15 during the fourth time D can be adjusted based on a delay value in the delay circuit 72, and a value of precharging voltage $V_A$ can be adjusted using the precharging voltage adjustment circuit 74. For example, the slope of the falling edge waveform of the gate pulse during the fourth time D increases as the delay value in the delay value 72 becomes smaller, whereas it decreases as the delay value in the delay circuit 72 becomes greater. The precharging voltage $V_A$ of the gate pulse during the fourth time D can be adjusted depending on a resistance value of the second resistor Rr of the precharging voltage adjustment circuit 74. If the precharging voltage adjustment circuit 74 is constituted by switching elements for switching resonance waveforms with an LC resonance circuit, the falling edge waveform of the gate pulse during the fourth time D can be controlled in a sinusoidal waveform. FIGS. 18A and 18B show examples where the maximum voltage at the second time B and the minimum voltage at the fourth time D are controlled to be different from each other by adjusting the second time B and the fourth time D.

As described above, according to the embodiments of this document, it is possible to reduce the power consumption and the kickback voltage ΔVp by generating the rising edge voltage and the falling edge voltage through the power sharing of the different voltage sources.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display panel assembly including data lines and gate lines intersecting each other;

a data driving circuit configured to convert digital video data into data voltages which are supplied to the data lines;

a gate driving circuit configured to sequentially supply gate pulses to the gate lines, wherein a voltage of each of the gate pulses increases from a gate low voltage to a precharging voltage during a first rising time all along the gate lines and thereafter increases from the precharging voltage to a gate high voltage during a second rising time all along the gate lines, and wherein the voltage of each of the gate pulses decreases from the gate high voltage to the precharging voltage during a first falling time all along the gate lines and thereafter decreases from the precharging voltage to the gate low voltage during a second falling time all along the gate lines, a timing controller which supplies the digital video data to the data driving circuit and controls operation timings of the data driving circuit and the gate driving circuit, wherein the timing controller generates gate shift clocks swinging in a TTL logic voltage level and a power sharing control signal for controlling the gate pulses, wherein the gate driving circuit comprises:

a level shifter configured to convert the gate shift clocks into the gate pulses under the control of the timing controller; and a shift register configured to sequentially supply the gate pluses output from the level shifter to the gate lines, wherein the level shifter comprises:

a first node configured to be applied with the precharging voltage;

a second node configured to output the gate pulses;

a power sharing switch circuit configured to be connected between the first node and the second node, applied with the precharging voltage via the first node, form a current path between first node and the second node during the first rising time and the first falling time, and block the current path between the first node and the second node during the second rising time and the second falling time;

a first transistor configured to be connected to the power sharing switch circuit and the second node and applied with the gate high voltage;

a second transistor configured to be connected to the power sharing switch circuit and the second node and applied with the gate low voltage; and a switch controller configured to control operation timings of the power sharing switch circuit, the first transistor, and the second transistor, in response to the gate shift clocks and the power sharing control signal.

2. The display device of claim 1, wherein a rising waveform of each of the gate pulses has a first inflection point between the first rising time and the second rising time.

3. The display device of claim 1, wherein a falling waveform of each of the gate pulses has a second inflection point between the first falling time and the second falling time.

4. The display device of claim 1, wherein a slope of a voltage varying during the first rising time is smaller than a slope of a voltage varying during the second rising time, at the rising edge of each of the gate pulses.

5. The display device of claim 1, wherein a slope of a voltage varying during the first falling time is smaller than a slope of a voltage varying during the second falling time, at the falling edge of each of the gate pulses.

6. The display device of claim 1, wherein a voltage at the rising edge of each of the gate pulses during the first rising time increases in a step waveform.

7. The display device of claim 1, wherein a voltage at the falling edge of each of the gate pulses during the first falling time decreases in a step waveform.

8. The display device of claim 1, wherein a voltage at the rising edge of each of the gate pulses during the first rising time increases in a sinusoidal waveform.

9. The display device of claim 1, wherein a voltage at the falling edge of each of the gate pulses during the first falling time decreases in a sinusoidal waveform.

10. The display device of claim 1, wherein the level shifter further comprises a delay circuit which delays control signals output from the switch controller.

11. The display device of claim 10, wherein the level shifter is provided with an option terminal, and wherein the switch controller selectively makes the first falling time and the rising time inactive depending on a voltage at the option terminal.

12. The display device of claim 11, wherein the timing controller applies a power sharing option signal to the option terminal to control waveforms of the gate pulses during the first rising time and the first falling time.

13. The display device of claim 1, wherein the power sharing switch circuit comprises:

a first diode configured to be connected to the first node and turned on during the first rising time to allow a third node between the first node and the second node to be connected to the first node;

a third transistor configured to be connected to an anode of the first diode via the first nod and turned on to allow the third node to be connected to the first node during the first falling time under the control of the switch controller;

a second diode configured to be connected between the third node and the second node and turned on to allow the second node to be connected to the third node during the first falling time; and a fourth transistor configured to be connected to a cathode of the second diode via the third node and connected to an anode of the second diode via the second node, and turned on to allow the third node to be connected to the second node during the first rising time under the control of the switch controller.

14. The display device of claim 13, wherein the first transistor is turned on to allow the gate high voltage to be applied to the second node during the second rising time under the control of the switch controller, and wherein the second transistor is turned on to allow the gate low voltage to be applied to the second node during the second falling time under the control of the switch controller.

15. The display device of claim 1, wherein the display panel assembly is provided with a TFT array where pixels and optical sensors for displaying video data are embedded.

16. The display device of claims 1 to 9, and 10 to 15, wherein the display device is one of a liquid crystal display (LCD), an organic light emitting diode (OLED) display, a field emission display (FED), and an electrophoresis display (EPD).

17. A method for controlling gate pulses in a display device having a display panel including data lines and gate lines intersecting each other; a data driving circuit configured to convert digital video data into data voltages which are supplied to the data lines; and a gate driving circuit configured to sequentially supply gate pulses to the gate lines, the method comprising:

increasing voltages of the gate pulses from a gate low voltage to a precharging voltage during a first rising time all along the gate lines;

increasing the voltages of the gate pulses from the precharging voltage to a gate high voltage during a second rising time all along the gate lines;

decreasing the voltages of the gate pulses from the gate high voltage to the precharging voltage during a first falling time all along the gate lines;

decreasing the voltages of the gate pulses from the precharging voltage to the gate low voltage during a second falling time all along the gate lines, supplying the digital video data to the data driving circuit, controlling operation timings of the data driving circuit and the gate driving circuit, and generating gate shift clocks swinging in a TTL logic voltage level and a power sharing control signal for controlling the gate pulses, wherein the gate driving circuit comprises:

a level shifter configured to convert the gate shift clocks into the gate pulses under the control of the timing controller; and a shift register configured to sequentially supply the gate pluses output from the level shifter to the gate lines, wherein the level shifter comprises:

a first node configured to be applied with the precharging voltage;

a second node configured to output the gate pulses;

a power sharing switch circuit configured to be connected between the first node and the second node, applied with the precharging voltage via the first node, form a current path between first node and the second node during the first rising time and the first falling time, and block the current path between the first node and the second node during the second rising time and the second falling time;

a first transistor configured to be connected to the power sharing switch circuit and the second node and applied with the gate high voltage;

a second transistor configured to be connected to the power sharing switch circuit and the second node and applied with the gate low voltage; and a switch controller configured to control operation timings of the power sharing switch circuit, the first transistor, and the second transistor, in response to the gate shift clocks and the power sharing control signal.

* * * * *